United States Patent [19]

Winter et al.

[11] Patent Number: 4,854,535

[45] Date of Patent: Aug. 8, 1989

[54] SHELF MOUNTING SYSTEM

[75] Inventors: Russell K. Winter, Crownsville; Thomas D. Harvey, Rockville; Nedim Savas, Bethesda; Richard S. Kain, Woodbine, all of Md.

[73] Assignee: Russell William, Ltd., Odenton, Md.

[21] Appl. No.: 97,683

[22] Filed: Sep. 17, 1987

[51] Int. Cl.[4] ..... E04G 5/06

[52] U.S. Cl. ..... 248/225.2; 108/108; 211/193; 211/208; 248/243; 248/248

[58] Field of Search ..... 248/225.1, 225.2, 247, 248/248, 243; 211/190, 193, 207, 208; 108/108

[56] References Cited

U.S. PATENT DOCUMENTS

| | | | |
|---|---|---|---|
| 1,842,786 | 1/1932 | Kirsch | 248/225.1 X |
| 2,236,044 | 3/1941 | Vanderveld et al. | 248/243 |
| 3,247,973 | 4/1966 | Ruhnke | 248/243 X |
| 3,368,227 | 2/1968 | Underdown, Jr. | 248/243 X |
| 4,151,917 | 5/1979 | Pugh | 248/243 X |
| 4,154,419 | 5/1979 | Breidenbach | 248/243 |
| 4,496,262 | 1/1985 | Sangster | 248/225.2 X |

FOREIGN PATENT DOCUMENTS

| | | | |
|---|---|---|---|
| 2801774 | 4/1979 | Fed. Rep. of Germany | 248/243 |

*Primary Examiner*—J. Franklin Foss
*Assistant Examiner*—David L. Talbott
*Attorney, Agent, or Firm*—Morton J. Rosenberg

[57] ABSTRACT

A shelf mounting system (100) is provided for releasably coupling a display shelf (10) to a substantially vertical planar surface (44) of a vertical support (40). The shelf mounting system (100) includes a bracket member (30) having a substantially vertically directed slot (38) at a first end (37). The bracket member (30) is adapted for coupling to a slotted standard (40) by a pair of hook shaped projections (32and 34) on a second end (39). Shelf mounting system (100) further includes an adaptor assembly (20) wherein an adaptor (22) is fixedly coupled on a first end (21) to a display shelf (10) and releasably coupled to the bracket member (30). The adaptor (20) further includes a pin (28) fixedly coupled within a pair of aligned poles (25 and 27) which engages the slot (38) of mounting bracket (30). Display shelf (10) is therefore supported by adaptor assembly (20), wherein pin (28) is engaged within slot (38) of mounting bracket (30) to support a portion of the load, and by second end (23) which bears against surface (44) of slotted standard (40) which distributes the remainder of the structural load.

16 Claims, 4 Drawing Sheets

100

SHELF MOUNTING SYSTEM

BACKGROUND OF THE INVENTION

1. Field of the Invention

This invention directs itself to a system for mounting display shelves to external surfaces which may be substantially vertical. In particular, this invention directs itself to a mounting system which provides structural support for display shelving without detracting from the aesthetics of the shelving or the contents therein. More in particular, this invention pertains to a system for mounting display shelves having an adaptor fixedly coupled to the display shelf for releasable coupling to a bracket member which couples the shelf and adaptor assembly to the external surface. Further, this invention directs itself to a mounting system for display shelves which allows the shelves to be mounted from the top edge of vertical partitions or supports or from slotted tubular standards, as is commonly used in perimeter and gondola display racks. Further, this invention pertains to a system where the basic component elements are formed of a substantially transparent composition material to allow users to visually inspect contents contained within the shelves from external the system. Additionally, this invention directs itself to a mounting system which is easily removable and mountable to the external surface.

2. Prior Art

Shelf mounting systems for display type shelves are well-known in the art. Shelf mounting systems for use with slotted standards are also well-known in the art. However, in many prior art systems there is provided a cradle type mounting for support of the display shelving. Such prior mounting systems support the shelf without being coupled thereto to provide a releasable coupling of the shelf to the bracket. This arrangement has the disadvantage of permitting the shelf to slide horizontally relative to the bracket, and thus cannot prevent the shelf from being knocked off the support brackets by a lateral force.

Other prior art systems have shelving which are integrally coupled to the mounting brackets. These systems therefore do not permit the shelving to be separated from the brackets for the quick interchange of the shelving and their contents. In addition, such prior art systems have mounting brackets which are large and unsightly and detract from the aesthetic appearance of the display system. These prior art mounting brackets must therefore be polished to a high luster finish so as to minimize the distraction from the aesthetic appearance of the display shelves. Such makes these prior art systems more expensive to manufacture and maintain.

The closest prior art known to Applicants is U.S. Pat. No. 4,151,917 directed to a shelf system. Such does utilize a shelf member which apparently is mounted to a standard, however, this prior art system does not provide for an adaptor assembly coupled on opposing ends to the shelf member and the standard, which increases the versatility and the bearing load capabilities of the subject Patent Application system. The prior art shelving system provides for a bracket member which is releasably coupled to a secondary bracket member passing external to the shelves wherein the external bracket member is in close proximity to the standard and thus, provides a more difficult mounting coupling for the shelving to the standard.

SUMMARY OF THE INVENTION

A shelf mounting system for releasably coupling at least one shelf member to a substantially vertical planar surface is provided. The shelf mounting system includes a bracket member having a substantially vertically directed slot formed on a first end thereof. The bracket member is adapted on a second end for coupling to the substantially vertical planar surface. The shelf mounting system also includes an adaptor assembly which provides a releasable coupling of the shelf member to the bracket member. The adaptor assembly is fixedly coupled to the shelf member and releasably coupled to the bracket member by virtue of the slot formed in the first end of the bracket member.

DESCRIPTION OF THE PREFERRED EMBODIMENTS

Referring now to FIGS. 1–5, there is shown shelf mounting system 100 for releasably coupling display shelves to a substantially vertical planar surface. As will be seen in following paragraphs, shelf mounting system 100 is specifically directed to the concept of providing a mounting system for display shelving which does not detract from the aesthetics of the display system and provides the capability of ease of changeability of the display shelf with its contents. Although not restricted to commercial utilization, shelf mounting system 100 is particularly adapted for use with display type systems in commercial establishments where it is desired to provide display shelving along a room perimeter, or from freestanding display gondolas. Additionally, shelf mounting system 100 provides for a structural support system for use by a wide variety of shelf designs to be mounted to an equally wide variety of mounting surfaces.

Figure 1:
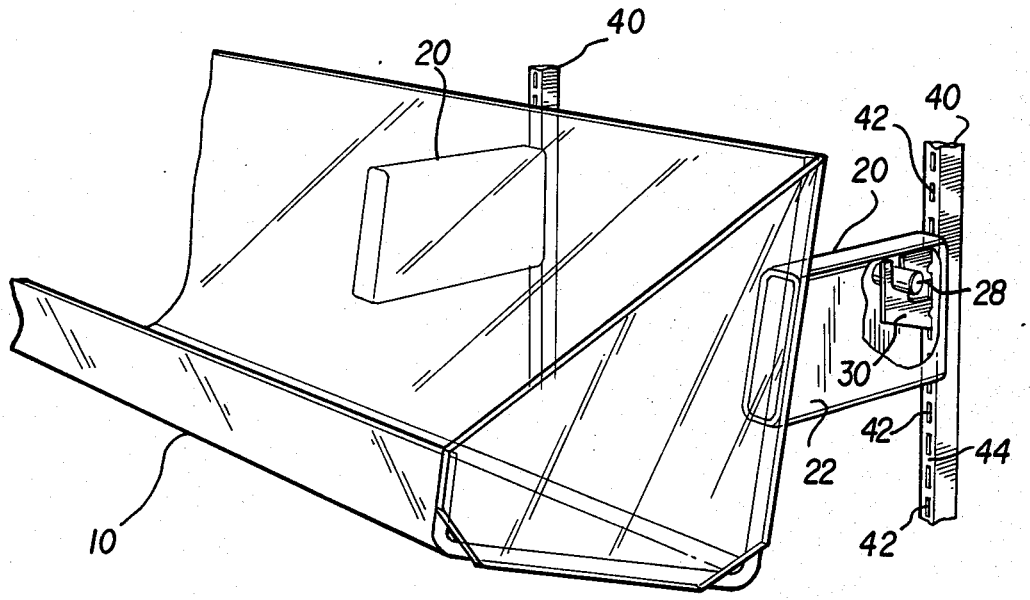
FIG. 1 is a perspective view of the shelf mounting system.
Figure 2:
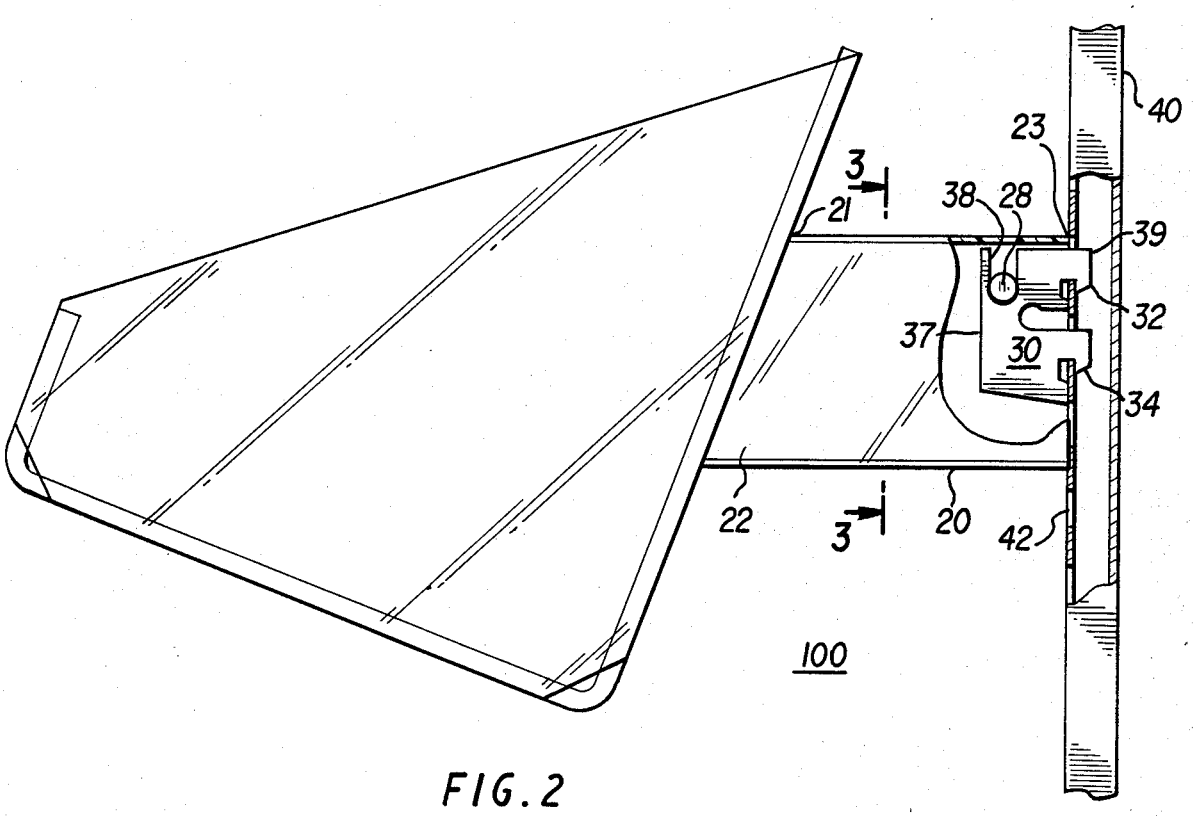
FIG. 2 is an end view of the shelf mounting system.

Referring now to FIGS. 1 and 2, there is shown shelf mounting system 100 wherein display shelf 10 is suspended from a pair of slotted substantially vertically extending standards 40. Although display shelf 10 is shown supported by a pair of slotted standards 40, it is to be understood that display shelf 10 could be supported by a single, centrally located, shelf mounting system 100 coupled to a single slotted standard 40, or a multiplicity of such assemblies, depending upon the structural support required for display shelf 10. Display mounting system 100 includes adaptor assembly 20 which in combination with bracket member 30 provides a releasable coupling to the slotted standard 40.

Adaptor assembly 20 includes adaptor 22 which is fixedly coupled to display shelf 10 at first end 21. Thus, once the bracket member 30 has been positioned on the slotted standard 40, display shelves 10 with fixedly attached adaptor assemblies 20 may be interchanged without upsetting the previously determined shelf spacing as defined by the distance between bracket members 30 which have been coupled to slotted standard 40, as will be described further in following paragraphs.

As shown in the Figures, bracket member 30 having a first end 37 with a substantially vertically directed slot 38 formed therein, is utilized to couple bracket member 30 to adaptor assembly 20. Adaptor assembly 20 includes pin 28 which when engaged by the substantially vertically directed slot 38 of bracket member 30 provides a releasable coupling of adaptor assembly 20, with display shelf 10 fixedly attached, to the vertical surface to which bracket member 30 has been coupled.

Bracket member 30 includes a pair of hook shaped projections 32 and 34 at a second end 39 for coupling with slotted standard 40, as will be described in following paragraphs.

Figure 3:
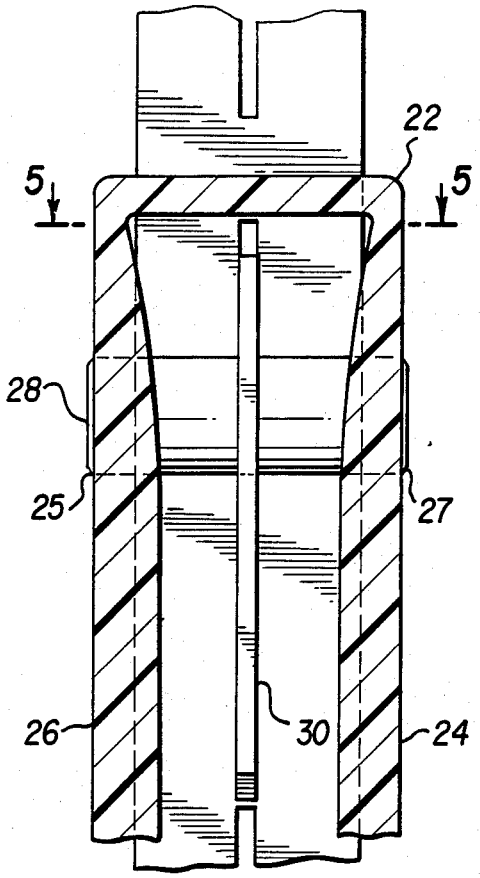
FIG. 3 is a sectional view of the mounting system taken along the section Line 3—3 of FIG. 2.
Figure 5:
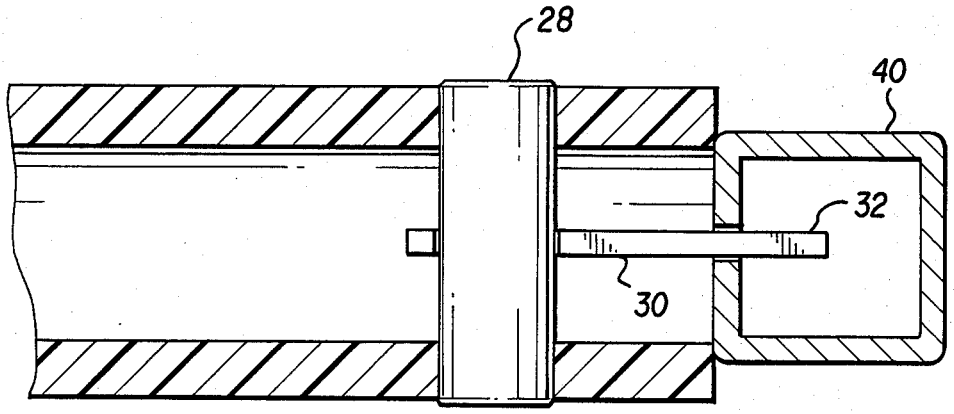
FIG. 5 is a sectional view of the mounting system taken along the section Line 5—5 of FIG. 3.

Referring now to FIGS. 3 and 5, there is shown a sectional view of adaptor assembly 20 coupled to bracket member 30. As shown, adaptor 22 includes a pair of opposing walls 26 and 24, each having a through hole 25 and 27, respectively, providing a horizontally aligned opening through adaptor 22. Pin 28 passes through the through opening formed by aligned holes 25 and 27 and is fixedly attached therein. Although not important to the inventive concept, pin 28 may be fixedly retained within holes 25 and 27 by frictional contact, as would be provided by an interference fit of pin 28 within holes 25 and 27, or by adhesive means, or like attachment.

As shown, pin 28 is seated within the vertical slot 38 of bracket member 30 providing the structural support for the suspension of display shelf 10, which is releasable without disturbing the vertical position and predetermined shelf spacing, by virtue of bracket member 30 remaining engaged with slotted standard 40.

Display shelf 10 and adaptor 22 are generally formed of a plastic-like composition which has the advantage of being lightweight and easily removable from its engagement with bracket member 30 and with the added advantage that display shelf 10 and adaptor 22 are easily molded in one-piece formation, or bonded by either adhesive or ultrasonic means. However, the particular composition of display shelf 10 and adaptor 22 is not important to the inventive concept as herein described. Additionally, shelf member 10 may be substantially transparent which includes the important functionality of allowing the user to view contents of goods contained in shelf 10.

Figure 4:
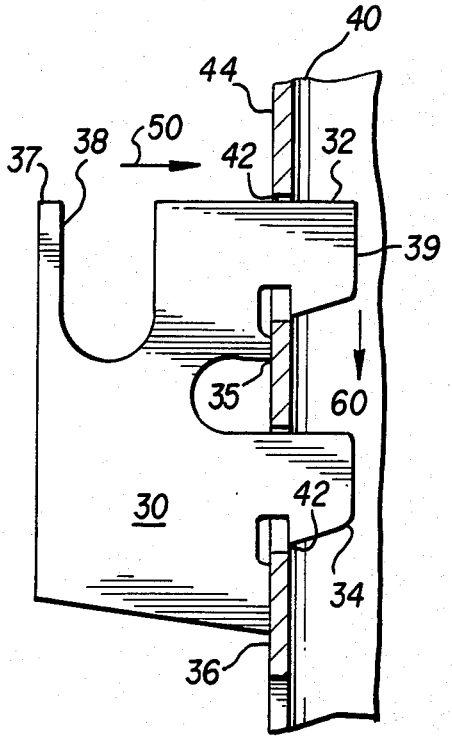
FIG. 4 is a cut-away plane view of the mounting bracket and slotted standard.

Referring now to FIG. 4, there is shown mounting bracket 30 having first hooked projection 32 and second hooked projection 34, both adapted for passage through the vertically directed slots 42 of slotted standard 40. Bracket member 30 is moved laterally along direction line 50 such that the hooked projections 32 and 34 pass through the slots 42 in slotted standard 40. When the bearing surfaces 35 and 36 of bracket member 30 strike the face 44 of slotted standard 40, bracket member 30 is displaced vertically downward along direction line 60 to secure bracket member 30 to slotted standard 40.

The hook shaped projections 32 and 34 in combination with the bearing surfaces 35 and 36 is a configuration well-known in the art for coupling bracket type elements to the slotted standard 40 which is also well-known in the art. Other methods for coupling bracket member 30 to vertical planar surfaces are possible by replacement of the hook shaped projections 32 and 34 with a plate member fixedly coupled to bracket member 30 and orthogonally directed relative to bracket member 30. This plate member may have through openings for screw type mounting to a wall or partition surface, or in the alternative, the plate member may have a channel or hook shaped end for coupling over the top edge of a vertical surface or partition. Although not important to the inventive concept, bracket member 30 is generally formed of a metallic-like composition, however, such may be formed of other compositions such as plastic or the like, as long as sufficient structural strength is provided for support of display shelf 10 and adaptor assembly 20.

As is seen in FIGS. 1 and 2, slotted standard 40 provides a vertical planar surface from which a display shelf 10 is suspended by novel shelf mounting system 100. Shelf mounting system 100 includes bracket member 30 which is coupled to the substantially vertical planar surface formed by slotted standard 40 to provide a means of releasably coupling display shelf 10 without interfering with the aesthetics of the display system, and without disturbing the previously determined shelf spacing of the display system.

Adaptor assembly 20 includes adaptor 22 which may have a substantially rectangular tubular cross-section wherein first end 21 of adaptor 22 is coupled to display shelf 10. Although adaptor 22 is shown with a rectangular tubular cross-section, it is within the scope of the inventive concept that adaptor 22 may be formed by a pair of opposing wall members through which pin 28 is secured, or may even be a single wall member with pin 28 cantilevered therefrom. Alternatively, differing contours may be provided for the tubular walls.

As seen in FIGS. 1, 2, 3, 4 and 5, pin 28 passes through a pair of aligned holes 25 and 27 in adaptor walls 26 and 24, respectively. Pin 28 is fixedly coupled within holes 25 and 27 to engage bracket member 30 within the substantially vertically directed slot 38 located at a first end 37 of bracket member 30. Thus, there is provided a unique releasable mounting system for a shelf bracket combination.

Shelf mounting system 100 provides a method for releasably coupling a display shelf to a mounting surface, such as a slotted standard, which allows shelf removability and interchange without displacing the shelf bracket from its predetermined position, which is advantageous over many prior art systems wherein the display shelf is fixedly coupled to the mounting bracket such that both are removed from the slotted standard to provide release of the shelf from the display system.

In addition, shelf mounting system 100 provides a means of load bearing not seen in the prior art. Prior art shelf mounting systems transmit the total load bearing forces to the hook shaped projections and bearing surfaces which form the engagement means with the well-known slotted standards. In opposition, shelf mounting system 100 divides the load between the engagement surfaces of mounting bracket 30 and the second end 23 of adaptor 22, which bears against surface 44 of slotted standard 40. This configuration spreads the load bearing forces over a larger surface area and therefore, may permit the use of a lighter gauge slotted standard 40 to be used for a particular display application, thus further reducing the overall cost of a display system wherein shelf mounting system 100 is utilized.

Figure 6:
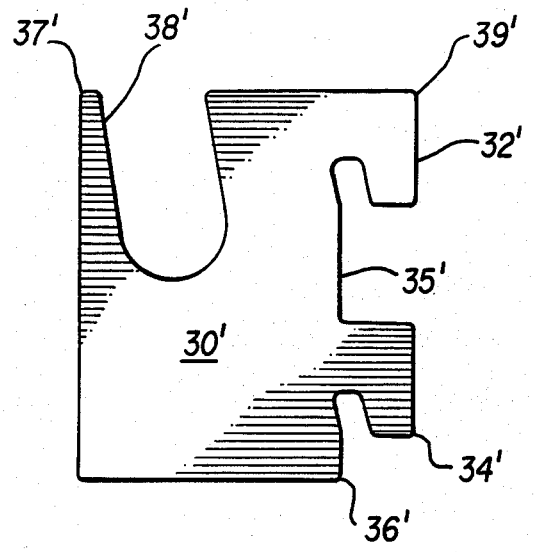
FIG. 6 is a plane view of another embodiment of the mounting bracket.

Referring now to FIG. 6, there is shown mounting bracket 30′ having an alternate configuration for use with the shelf mounting system of FIGS. 1 and 2. Mounting bracket 30′ similarly includes a pair of hook shaped projections 32′ and 34′ and bearing surfaces 35′ and 36′ for similar engagement to a slotted standard 40, as has previously been described.

Mounting bracket 30′ is provided at first end 37′ with a substantially vertically directed slot 38′, which is offset at an acute angle relative to the second end 39′. The acute angle of slot 38′ improves the fit of second end 23 of adaptor 22 with surface 44 of slotted standard 40. As a means to compensate for variation in tolerances of the combined elements of shelf mounting system 100, slot 38′ is offset or inclined at an angle having a range of from 5.0°–15.0°, wherein an approximate value of 10.0° has been found to operate successfully with a working embodiment of shelf mounting system 100, as herein described.

Inclined slot 38′ of mounting bracket 30′ provides a means of compensation for tolerance build-up by allowing second end 23 of adaptor 22 to always strike the surface 44 of slotted standard 40 prior to the pin 28 bottoming out on the slot 38′. Slot 38′ may be inclined by forming slot 38′ at the predetermined angle, or by inclining the bracket 30′ by displacing the bearing surface 36′ relative to the bearing surface 35′.

Slotted standards of some display systems are formed in a recessed manner between decorative panels. Other display systems have pleated fabric or other deformable materials where it is generally deemed undesirable to have second end 23 of adaptor 22 contiguously interfacing thereon.

Figure 7:
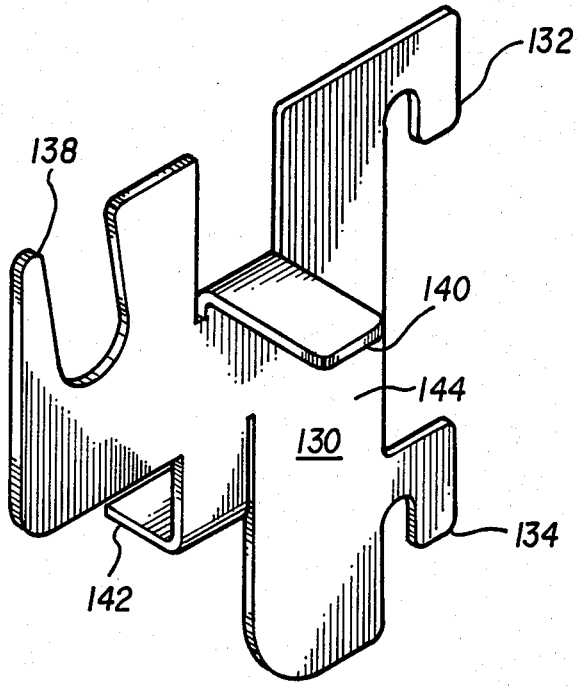
FIG. 7 is a perspective view of another embodiment of the mounting bracket.
Figure 8:
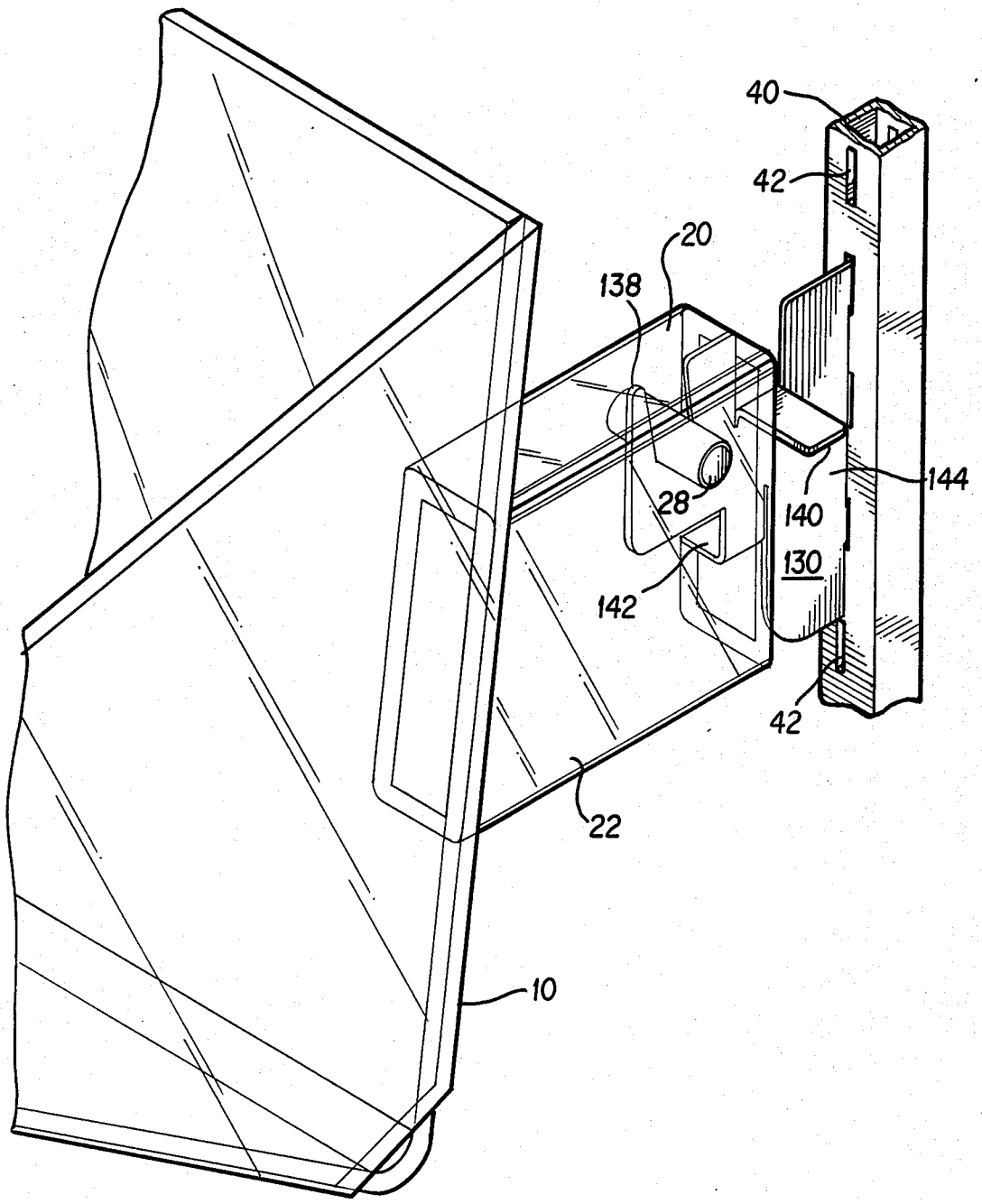
FIG. 8 is a perspective view of the shelf mounting system utilizing the bracket of FIG. 7.

In such applications it is advantageous to use mounting bracket 130, as shown in FIGS. 7 and 8. Mounting bracket 130 may be used for display system 100 where a bearing surface of shelf adaptor 22 is separately provided.

As is shown in FIGS. 7 and 8, mounting bracket 130 may be formed in one-piece construction of metal or some like material composition. Inclined slot 138 is formed on a first end, and a pair of hook shaped projections 132 and 134 on opposing ends thereof, as was described for previous embodiments.

Intermediate inclined slot 138 and projections 132 and 134 are formed a pair of opposingly horizontally directed tabs 140 and 142. Tabs 140 and 142 pass from opposing substantially planar surfaces of bracket member 130.

As is clearly seen, tab 140 passes substantially normal to planar surface 144 of mounting bracket 130. Similarly, tab 142 passes in an opposing horizontally directed manner from an opposing surface of planar surface 144.

Tabs 142 and 144 may be then mounted on end walls of adaptor 22 and provides the bearing surface for second end 23 of adaptor 22 when pin 28 is engaged within slot 138 of bracket 130.

In this manner there is provided shelf mounting system 100 for applications which require the total load bearing support to be provided by the conventional slotted standard coupling method.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A shelf mounting system for releasably coupling at least one shelf member to a substantially vertical planar surface, comprising:

a. a pair of horizontally displaced bracket members each having a substantially vertically directed slot formed on a first end thereof; each of said bracket members being adapted for coupling to said substantially vertical planar surface on a second end thereof; and, b. adapter means for releasably coupling said shelf member to said pair of bracket members, said adapter means including (1) a pair of socket members each being fixedly coupled to said shelf member on a first end thereof, and releasably coupled to a respective bracket member within said slot formed in said first end of said bracket member, and (2) a pair of pin members for reversibly engaging said pair of bracket members within said slot formed in said first end of each said bracket members, each of said pair of pin members being coupled to a second end of a respective one said socket members, each of said socket members having a closed contour cross-section having a substantially planar end for bearing against said substantially vertical planar surface for dispersing load bearing forces over an extended area of said socket members, said closed contour cross-section is defined in part by a pair of opposing wall members having a pair of aligned through openings passing therethrough, each of said pin members being coupled to a respective one of said socket members by passing through said pair of aligned through openings, whereby said pair of opposing wall members define a space therebetween for compensation of variations in said horizontal displacement of said bracket members.

2. The mounting system as recited in claim 1 where said second end of said bracket member includes a pair of hook shaped projections for releasable coupling to said substantially vertical planar surface, said substantially vertical planar surface having a plurality of substantially vertically directed slots for releasable engagement with said pair of hook shaped projections.

3. The mounting system as recited in claim 1 where said second end of said bracket member is fixedly coupled to a plate member, where the planes formed by said bracket member and said plate member are substantially orthogonal.

4. The mounting system as recited in claim 3 where said plate member includes at least one hole formed therein, said hole having a predetermined diameter for passage of a fastener therethrough, said fastener coupling said plate member to said substantially vertical planar surface.

5. The mounting system as recited in claim 3 where said plate member includes a channel formed on a first end for releasable coupling with an uppermost end of said substantially vertical planar surface.

6. The mounting system as recited in claim 1 where said slot formed in said first end of said bracket member is offset at an acute angle relative to said second end of said bracket member for limiting rotation of said shelf about said releasable coupling of said adaptor means to said bracket member within said slot.

7. The mounting system as recited in claim 6 where said acute angle of said slot has an approximating range of 5 to 15 degrees relative to said second end of said bracket member.

8. A shelf mounting system for releasably coupling at least one shelf member to at least one slotted support member, comprising:

a. a bracket member having a pair of opposing planar surfaces wherein a substantially vertically directed slot is formed therethrough at a first end thereof; said bracket member being adapted for coupling to said slotted support member on a second end thereof; said bracket member further including a pair of oppositely directed tab members extending from said planar surfaces, each of said tab members having a load bearing edge surface directed toward said first end of said bracket member; and, b. adapter means for releasably coupling said shelf member to said bracket member, said adapter means being fixedly coupled to said shelf member on a first end and releasably coupled to said bracket member within said slot formed in said bracket member; said adapter means being further supported by contiguously interfacing an end surface of a second end of said adapter means with said load bearing edge surface of said pair of tab members, said adapter means having a closed contour cross-section wherein said end surface of said second end is substantially planar for distributing load bearing forces over an extended area of said adapter means when said tab members contiguously interface with said second end of said adapter means.

9. The mounting system as recited in claim 8 where said adaptor means includes a socket member fixedly coupled to said shelf on a first end.

10. The mounting system as recited in claim 9 where said socket member includes a pair of opposing wall members, said opposing wall members having a pair of aligned through openings passing therethrough.

11. The mounting system as recited in claim 10 where said adaptor means further includes a pin member for reversibly engaging said bracket member within said slot formed in said first end of said bracket member.

12. The mounting system as recited in claim 11 where said pin member passes through said pair of aligned through openings in said socket member, and is fixedly coupled therein.

13. The mounting system as recited in claim 8 where said second end of said bracket member includes a pair of hook shaped projections for releasable coupling to said slotted support member, said support member having a plurality of substantially vertically directed slots formed therein for releasable engagement with said pair of hook shaped projections.

14. The mounting system as recited in claim 8 where said slot in said bracket member is offset at an acute angle relative to said second end of said bracket member for limiting rotation of said shelf about said releasable coupling of said adaptor means to said bracket member within said slot.

15. The mounting system as recited in claim 14 where said acute angle of said slot has an approximating range of 5 to 15 degrees relative to said second end of said bracket member.

16. The mounting system as recited in claim 8 where said pair of opposingly directed tab members are vertically aligned one to the other.

* * * * *